US011873579B1

(12) United States Patent
Pires

(10) Patent No.: US 11,873,579 B1
(45) Date of Patent: Jan. 16, 2024

(54) HEMP SEPARATION METHODS AND APPARATUS

(71) Applicant: Tom Pires, Riverdale, CA (US)

(72) Inventor: Tom Pires, Riverdale, CA (US)

( * ) Notice: Subject to any disclaimer, the term of this patent is extended or adjusted under 35 U.S.C. 154(b) by 0 days.

(21) Appl. No.: 17/877,751

(22) Filed: Jul. 29, 2022

(51) Int. Cl.

| | |
|---|---|
| ***D01B 1/24*** | (2006.01) |
| ***D21B 1/06*** | (2006.01) |
| ***D01B 1/40*** | (2006.01) |
| ***D01B 1/32*** | (2006.01) |

(52) U.S. Cl.
CPC ..... *D01B 1/24* (2013.01); *D01B 1/32* (2013.01); *D01B 1/40* (2013.01); *D21B 1/061* (2013.01)

(58) Field of Classification Search
CPC ... D01B 1/10; D01B 1/14; D01B 1/24; D01B 1/26; D01B 1/28; D01B 1/32; D01B 1/38; D01B 1/40; B02C 23/10
See application file for complete search history.

(56) References Cited

U.S. PATENT DOCUMENTS

| | | | | | |
|---|---|---|---|---|---|
| 1,447,449 | A | | 3/1923 | Wessel | |
| 2,293,056 | A | | 8/1942 | Gardner | |
| 2,316,590 | A | * | 4/1943 | Johnson | D01B 1/24 19/94 |
| 2,399,809 | A | * | 5/1946 | Kaiser | D01B 1/14 19/31 |
| 2,755,511 | A | | 7/1956 | Godtel | |
| 2,957,209 | A | | 10/1960 | Schulze | |
| 3,064,315 | A | | 11/1962 | Schneider | |
| 4,666,033 | A | * | 5/1987 | Reid | B65G 33/30 198/677 |
| 4,959,038 | A | * | 9/1990 | Ragsdale | D01B 1/14 460/149 |
| 5,316,150 | A | * | 5/1994 | Fisher | B07B 9/00 209/23 |
| 5,465,464 | A | | 11/1995 | Chen et al. | |
| 5,466,188 | A | | 11/1995 | Schaal et al. | |
| 5,507,074 | A | | 4/1996 | Chen et al. | |
| 5,513,805 | A | * | 5/1996 | Fisher | B07B 1/20 241/73 |
| 5,970,582 | A | * | 10/1999 | Stover | D01B 1/40 19/24 |
| 6,079,647 | A | | 6/2000 | Leduc et al. | |

(Continued)

FOREIGN PATENT DOCUMENTS

| | | | |
|---|---|---|---|
| CA | 2919565 | C | 3/2018 |
| CN | 102206872 | A | 10/2011 |

(Continued)

OTHER PUBLICATIONS

English machine translated abstract of CN102206872A downloaded from "https://worldwide.espacenet.com/patent/search/family/044695922/publication/CN102206872A?q-pn%3DCN102206872A" Aug. 1, 2022.

(Continued)

*Primary Examiner* — Aiying Zhao
(74) *Attorney, Agent, or Firm* — Sierra IP Law, PC; Mark D. Miller

(57) ABSTRACT

The present invention provides improved hemp decortication systems and methods, and include multi stage segmenting, cleaning, and combing methods and apparatus for separating fibrous plant stalk, and particularly for separating hemp bast fiber from hemp hurd.

9 Claims, 6 Drawing Sheets

(56) References Cited

U.S. PATENT DOCUMENTS

| | | | |
|---|---|---|---|
| 7,520,214 | B2 | 4/2009 | Dehondt |
| 8,650,717 | B2 | 2/2014 | Hao et al. |
| 10,051,802 | B2 | 8/2018 | Paulitz et al. |
| 11,091,852 | B2 | 8/2021 | Pildysh |
| 11,102,934 | B2 | 8/2021 | Jin |
| 2018/0103591 | A1 | 4/2018 | Jin |
| 2018/0304274 | A1 | 10/2018 | Bates |
| 2020/0398285 | A1 | 12/2020 | Pildysh |
| 2021/0189597 | A1 | 6/2021 | Czinner et al. |
| 2022/0056618 | A1 | 2/2022 | Beaven |

FOREIGN PATENT DOCUMENTS

| | | | | | |
|---|---|---|---|---|---|
| CN | 110916225 | A | | 3/2020 | |
| CN | 212316286 | U | | 1/2021 | |
| EP | 1155172 | B1 | | 9/2005 | |
| EP | 2018447 | B1 | | 1/2015 | |
| GB | 191210816 | A | * | 11/1912 | ..... D01B 1/14 |
| GB | 2205865 | A | | 12/1988 | |
| RO | 134839 | A2 | | 3/2021 | |
| RU | 2202933 | C2 | | 4/2003 | |
| WO | 1997045573 | A1 | | 12/1997 | |
| WO | 2000014312 | A1 | | 3/2000 | |
| WO | 2004088006 | A1 | | 10/2004 | |
| WO | 2006094359 | A1 | | 9/2006 | |
| WO | 2011086564 | A1 | | 7/2011 | |

OTHER PUBLICATIONS

English machine translated abstract of CN110916225A downloaded from "https://worldwide.espacenet.com/patent/search/family/069852964/publication/CN110916225A?q-pn%3DCN110916225A" Aug. 1, 2022.

English machine translated abstract of CN212316286U downloaded from "https://worldwide.espacenet.com/patent/search/family/074026086/publication/CN212316286U?q=pn%3DCN212316286U" Aug. 1, 2022.

English machine translated abstract of RO134839A2 downloaded from "https://worldwide.espacenet.com/patent/search/family/068696189/publication/RO134839A2?q=pn%3DRO134839A2" Aug. 1, 2022.

English machine translated abstract of RU2202933C2 downloaded from "https://worldwide.espacenet.com/patent/search/family/020245829/publication/RU2202933C2?q=pn%3DRU2202933C2" Aug. 1, 2022.

The Compatible Pair (ad), Allied Products Corporation, 2000.

Little David and Little David, Jr. Stick Leaf and Hull Remover, Bulletin RC-75, Continental Gin Machinery, 1st Ed., 1964.

Golden Eagle Series Extractor-Feeder, 2000.

Lummus Cotton Gin Co., Service Manual and parts list, Imperial 88 Saw Gin, 1965.

Lummus Model 700 Feeders manual, 1993.

Canadian Greenfield Technologies Corp., HempTrain web site, Jul. 25, 2022 (https://canadiangreenfield.com/hemptrain/).

* cited by examiner

HEMP SEPARATION METHODS AND APPARATUS

FIELD OF THE INVENTION

The present invention relates to methods and apparatus for separating fibrous plant materials, and more particularly, to apparatus, machines, assemblies and processes operable to separate hemp hurd from hemp bast fiber through segmentation, cleaning, and combing of fibrous hemp plant stalks.

BACKGROUND OF THE INVENTION

Hemp has always been a source of fiber that has traditionally been used to make clothing, textiles and rope, among other things. The fibrous outer surface of a hemp stalk known as bast fiber (bark) is made up of long, strong and durable fibers that are well suited for these uses. The inner hurd fibers of the hemp plant are short, but also strong and flexible, and may be used in fiberboard, compost, and animal bedding and may be used to make paper, composites and building materials. Separating the bast fiber from the hurd is accomplished through a process called decortication. Decortication traditionally involves the use of a machine called a decorticator to separate the tough, woody, corky interior of the hemp plant (hurd) from the soft, fibrous exterior (bast).

Mature hemp plants are harvested by cutting a few inches above the soil. After harvesting, the plants may then undergo a process called "retting" by which the surface of the harvested hemp plants are allowed to decay for a time. This makes it easier to separate the bast fiber from the hurd. The first step in the decortication process involves breaking the hemp stalks into pieces through a process called "breaking" in which stalks are passed between fluted rollers to shatter or break the hard, woody core into small bits, separating it from the fiber. This may be followed by a "scutching" process which involves beating the fiber bundles to further separate the raw materials from other material. This is followed by "hacking" which involves combing shorter or broken fibers out of the stalk.

An example of a decortication machine is disclosed in U.S. Pat. Publ. 2020/0398285 (Pildysh) in which plant stalks are first unbaled and then passed through crusher comprising a pair of rollers having a gap between them for receiving the stalks, the rollers having ridges on their outer surfaces. The output from the crusher is then sent to a first high speed bladed drum which pulls and whips the plant stalks through a gap above a plurality of rods, separating the outer fiber from the hurd. The process is repeated by sending the outer fiber through a second high speed drum which again whips the fiber, after which the fiber is then sent to a screened shaker for further separation. The whipping action of this system may damage the bast fibers thereby weakening or shortening them, making them less useful for many applications; this system does not necessarily produce high quality hurd which is must be highly purified for use in many applications; and this system includes a number of different separately manufactured components making it expensive to build and maintain.

It is therefore desirable to provide hemp decortication methods and apparatus that are relatively easy and inexpensive to make and use, and which provide as much separation of bast fiber from hurd, thereby producing both high quality bast fiber for use in clothing, textiles and the like, as well as high quality hurd for use in paper, composites, building materials and the like.

SUMMARY OF THE INVENTION

The present invention provides improved hemp decortication systems and methods. Embodiments of the present invention may include multi stage segmenting, cleaning, and combing methods and apparatus for separating fibrous plant stalk, and particularly for separating hemp bast fiber from hemp hurd. Embodiments of the present invention may include an initial stalk splitting/separation apparatus or stick machine operable to split and segment fibrous plant stalk. In some embodiments, the hurd output from the stick machine apparatus may be further purified by being sent first to a hammer mill, and then to a scrubber apparatus, resulting in removal of over 95% of the fibrous bast from the hurd. This purification process results in hurd that may be useful in many applications including making fine materials such as paper, or mixing with binders for use in building materials. In these embodiments, the scrubber may comprise an upwardly angled trough having a lower surface comprised of wire mesh through which separated hurd may fall, and an auger deployed in the upwardly angled trough to urge the plant fiber through the trough.

In embodiments of the invention, the bast fiber output from the stick machine apparatus may be further purified by sending it first through a feeder apparatus for further separation, and then through a condenser/comber apparatus. The feeder apparatus may comprise a pair of feed rollers between which the fiber is passed. In embodiments of the invention, one of the rollers is designed to rotate faster than the other in order to spread out the fibrous material. In some embodiments, this ratio of speeds may be approximately 3:1. In the feeder, the output from the pair of rollers drops onto a first of plurality of downwardly stepped spiked cylinders all rotating in the same direction above a slotted screen. The rotation of the spiked cylinders causes hurd to fall through the screen and bast fiber to travel along the top to a slide where gravity takes it down to a stationary brush. From there, the bast fiber travels onto a rotating extractor saw cylinder below the brush, which may have grid bars along one side through which additional separated hurd may pass. The bast fiber then travels down to a rotating doffing brush which removes fiber from the cylinder, then down to a reclaiming saw cylinder having spaced bars around and underneath it through which additional separated hurd may fall. The separated hurd drops through the grid bars adjacent to each cylinder and is removed, and the bast fiber may then be sent down an apron, through a duct having a rectangular cross section and then to a condenser/comber apparatus.

Embodiments of the condenser/comber apparatus include an upper condenser chamber having a centrally mounted rotating drum therein. The exterior surface of the drum includes a plurality of openings, wire mesh or screen, and the center of the drum is attached to air removal devices. This causes the fiber entering the chamber to be sucked against the openings, mesh or screen of the drum as it rotates. In embodiments of the invention, a pair of fluted rollers are provided at the bottom of the drum to strip the fiber from the screen of the drum as it rotates. In some embodiments, steel plates may be provided to stiffen the flashing against the fluted rollers. In embodiments of the invention, the fiber stripped from the drum is then dropped into a combing apparatus comprising a large central rotatable drum having teeth on the outer surface thereof which engage the fiber and bring it into contact with a plurality of lint combing blades spaced around the drum. As the fiber on the drum encounters the blades, it is combed to remove any remaining foreign material. It is then removed from the drum resulting in elongated fibrous output suitable for many different high-fiber applications. In addition, the hurd removed during these processes is of high quality making it suitable for use in building materials, paper, paperboard, composites and the like.

In one aspect embodiments of the present invention provide apparatus for decorticating hemp comprising an initial separation apparatus comprising a plurality of rotatable saw cylinders each saw cylinder being adjacent to a blade for separating inner and outer fibers of the plant stalks that pass between each saw cylinder and its respective blade, and a plurality of rotatable doffing cylinders adjacent to said saw cylinders for removing the outer fibers from the saws while the inner fibers drop through the apparatus; a feeder unit comprising a pair of upper rollers wherein one of the rollers rotates at least twice as fast as the other roller to spread out the fibers, a plurality of inclined rotatable spiked cylinders located above a slotted screen for further removal of outer fibers while the inner fibers drop through the screen, an upper rotatable saw cylinder having a plurality of grid bars next to it, a lower rotatable saw cylinder having a second plurality of grid bars underneath it, and a lower rotatable doffing cylinder for removing inner fibers form said first and second saw cylinders while inner fibers and trash pass through said grid bars; a condenser comprising a rotatable drum having an outer surface comprising a plurality of openings and a suction inside said drum for holding said inner fibers against said outer surface, and a pair of rotatable fluted rollers located below said drum for removing said inner fiber from said outer surface; and a combing apparatus comprising a rotatable drum having teeth on an exterior surface thereof and a plurality of blades adjacent to said surface for combing out foreign material from said fibers.

In some aspects, the initial separation apparatus comprises three saw cylinders and two doffing cylinders, in which the saw cylinders comprise saw blades with deep saw teeth separated by spacers between said saw blades. In some aspects, the saw blades may have a size of between about 1/16 inch and about 1/4 inch, the deep saw teeth may have a size of between about 1/16 inch and about 1/4 inch, and the saw blades may be separated by a space of between about 1/4 inch and about 3/4 inch. In some aspects, the saw blades may have a size of about 1/8 inch, the deep saw teeth have a size of about 5/16 inch, and the saw blades may be separated by a space of about 1/2 inch. In some aspects, the ratio of the speed of one of said upper rollers with respect to the other of said upper rollers is may be three to one (3:1); two and one half to one (2.5:1); or two to one (2:1).

In some aspects, the slotted screen of the feeder unit may comprise openings having a size of between about 2 inches by about 1/2 inch, to about 1 inch by about 1/8 inch. In some aspects, the slotted screen of the feeder unit may have openings with a size of about 1 1/2 inches by about 3/16 inch. In some aspects, a steel plate is provided adjacent to the pair of fluted rollers of said condenser. In some aspects, the combing apparatus includes a feed bar and a plurality of grid bars, and a leading edge of the feed bar has a radius of between about 1/16 inch and about 1/4 inch, preferably about 1/8 inch. In some aspects, the grid bars are spaced apart between about 1/16 inch and about 1/4 inch, preferably the grid bars are spaced apart about 1/8 inch.

In another aspect embodiments of the present invention provide methods for decorticating hemp comprising the steps of introducing harvested plant stalks into a top of an initial separation apparatus comprising a plurality of rotating saw cylinders each cylinder having an exterior surface comprising a plurality of teeth, each saw cylinder having at least one blade provided next to and along its exterior surface, and a plurality of rotating doffing cylinders adjacent to said saw cylinders, such that inner and outer fibers of the plant stalks are separated when the stalks pass between the teeth and blade of each saw, the outer fibers are doffed from the saws by the doffing cylinders, and the inner fibers drop through the apparatus; sending the outer fibers from the initial separation apparatus between a pair of upper rollers of a feeding unit wherein one of the rollers rotates at least twice as fast as the other roller to spread out the fibers; transferring the spread out fibers from the upper rollers onto a plurality of inclined rotating spike cylinders located above a slotted screen such that outer fibers are further separated from inner fibers as the spread out fibers pass between the spiked cylinders and the screen, the outer fibers exiting from underneath the spiked cylinders and the inner fibers dropping through the screen; sending the fibers exiting from the spiked cylinders onto an upper rotating saw cylinder having a plurality of grid bars next to it, and then to a lower rotating saw cylinder having a second plurality of grid bars underneath it, wherein both of said saw cylinders are adjacent to a lower rotating doffing cylinder that removes inner fibers form said first and second saw cylinders, and inner fibers and trash pass through the grid bars; transferring the inner fibers removed form said lower doffing cylinder to a condenser comprising a rotating drum having an outer surface comprising a plurality of openings and a suction inside said drum for holding said inner fibers against said outer surface, and removing said inner fiber from said outer surface using a pair of rotating fluted rollers located below said drum; and sending the fibers from said rotating fluted rollers to a combing apparatus comprising a rotating drum having teeth on an exterior surface thereof and a plurality of blades adjacent to said surface for combing out foreign material from said fibers.

It is therefore an object of the present invention to provide methods and apparatus for separating fibrous materials in plant stalks.

It is also an object of the present invention to provide methods and apparatus for segmenting, cleaning, and combing fibrous plant stalks.

It is also an object of the present invention to provide methods and apparatus for separating hemp bast fiber from hemp hurd so that both the bast fiber and hurd may be used to make other products.

It is also an object of the present invention to provide methods and apparatus for decorticating hemp without causing undue damage the bast fiber or hurd.

It is also an object of the present invention to provide methods and apparatus for decorticating hemp to produce hurd having a purity of at least 95%.

It is also an object of the present invention to provide methods and apparatus for inexpensively retrofitting existing cotton gin equipment for use in decorticating hemp.

The above-described objects, advantages and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention, including different combinations of the features identified herein. In the following disclosure, specific details are given to provide a thorough understanding of the invention. However, it will be apparent to one skilled in the art that the present invention may be practiced without all of the specific details provided.

Figure 1:
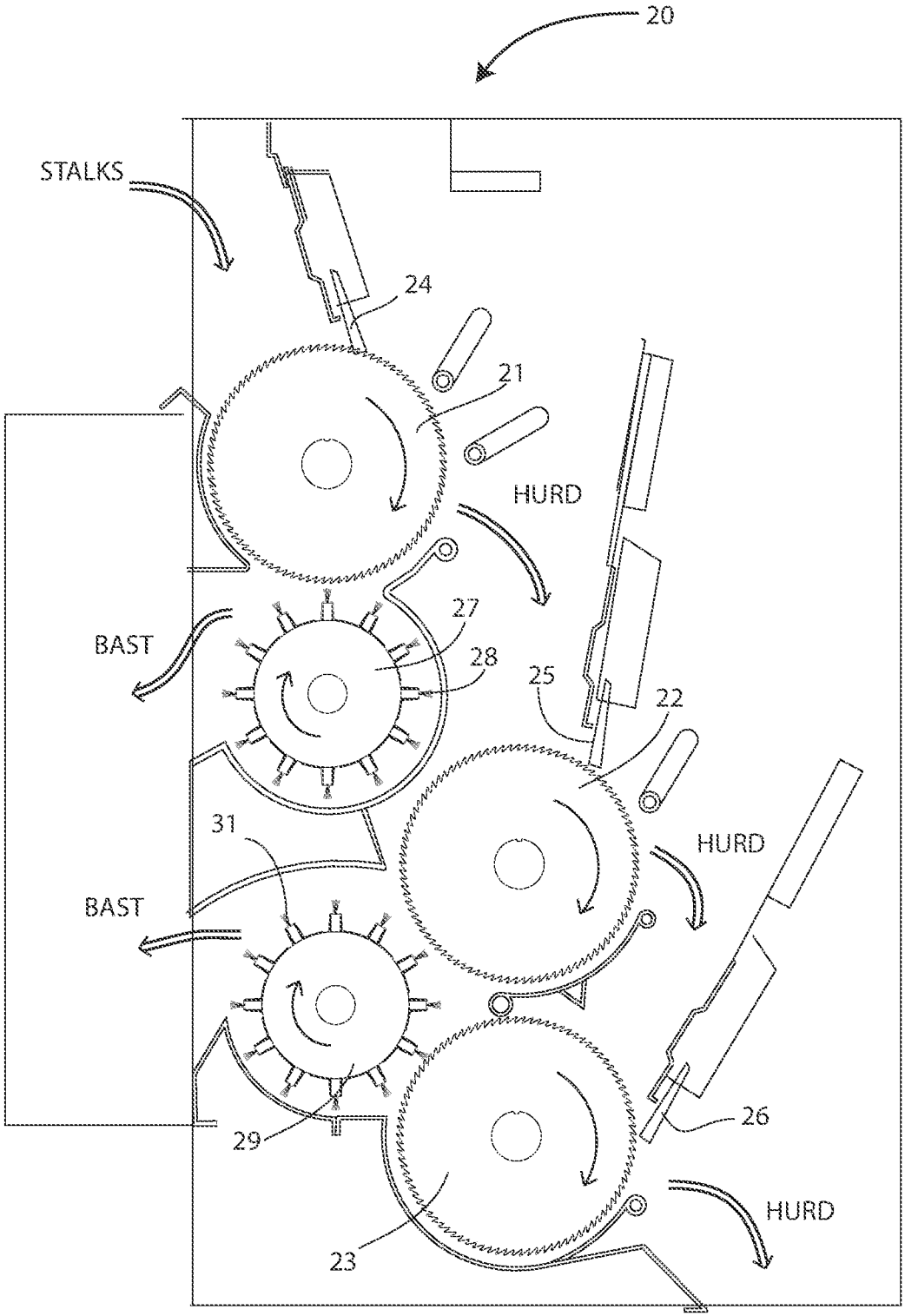
FIG. 1 is a side schematic view of an embodiment of an initial stalk splitting and separation apparatus (stick machine) of the present invention.

Referring to the drawings, wherein like reference characters designate like or corresponding parts throughout the several views, and referring particularly to FIG. 1 it is seen that a first apparatus of embodiments of the present invention includes an initial stalk splitting and separation apparatus or stick machine 20 used for rough separation of plant fibrous material. Harvested fibrous plant stalks are introduced at the top of the machine 20 an encounter a first rotatable separating saw cylinder 21 having a plurality of teeth on its external surface. In some embodiments, the blades of saw cylinder 21 may have a length or width of between about 1/16" and about 1/4", preferably about 1/8"; the saw teeth may have a size of between about 1/16" and about 1/4", preferably about 5/16" deep; and the saw blades may be separated by a spacer of between about 1/4" and about 3/4", preferably about 1/2" between saw blades. The fiber that encounters cylinder 21 is pulled underneath a first brush 24 to begin the separation of outer plant stalk fiber (bast fiber) from inner plant stalk fiber (hurd). The shorter inner fiber falls off saw cylinder 21, and the longer outer fiber is clinging to saw cylinder 21 is removed using a rotatable doffer drum 27 with brushes 28.

The inner fiber then drops onto a second rotatable separating saw cylinder 22 also having a plurality of teeth on its external surface. In some embodiments, the blades of saw cylinder 22 may have a length or width of between about 1/16" and about 1/4", preferably about 1/8"; the saw teeth may have a size of between of between about 1/16" and about 1/4", preferably about 5/16" deep; and the saw blades may be separated by a spacer of between about 1/4" and about 3/4", preferably about 1/2" between saw blades. The fiber that encounters cylinder 22 is pulled underneath a second brush 25 to further the separation of bast fiber from hurd. The shorter hurd falls off saw cylinder 22, and the longer bast fiber clings to saw cylinder 22, and is removed using a second rotatable doffer drum 29 with brushes 31. The inner fiber then drops onto a third rotatable separating saw cylinder 23 also having a plurality of teeth on its external surface. In some embodiments, the blades of saw cylinder 23 may have a length or width of between about 1/16" and about 1/4", preferably about 1/8"; the saw teeth may have a size of between about 1/16" and about 1/4", preferably about 5/16" deep; and the saw blades may be separated by a spacer of between about 1/4" and about 3/4", preferably about 1/2" between saw blades. The fiber that encounters cylinder 23 is pulled underneath a third brush 26 to further the separation of bast fiber from hurd. The shorter hurd falls off saw cylinder 23, and the longer bast fiber clings to saw cylinder 22, and is removed using a second rotatable doffer drum 29 with brushes 31.

Figure 2:
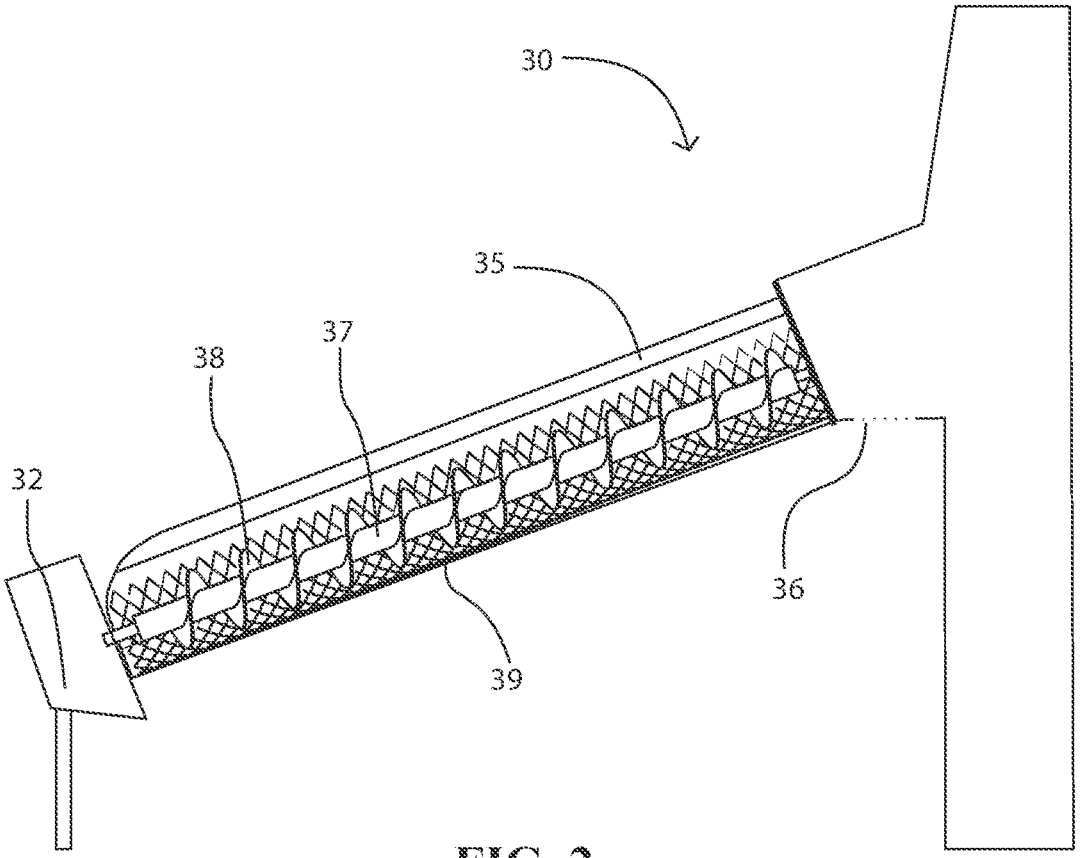
FIG. 2 is a side schematic view of an embodiment of a hurd scrubbing apparatus of the present invention.
Figure 2A:
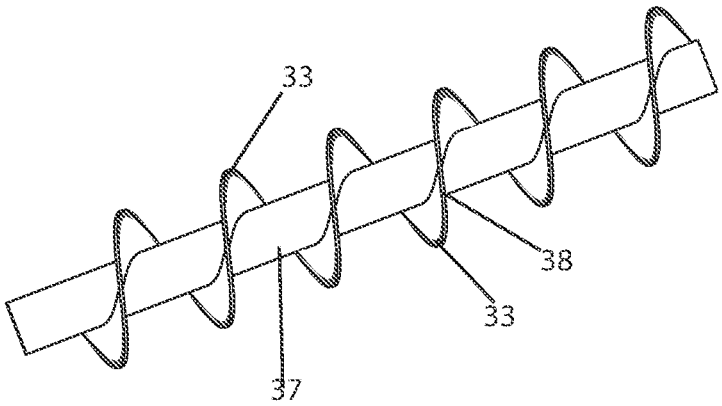
FIG. 2A is a close up view of an auger of an embodiment of the present invention.

FIG. 2 illustrates an exemplary embodiment of a scrubber 30 used to process hurd received from an initial process, such as that performed by stick machine 20. The hurd output from the stick machine 20 may be further purified by being sent first to a hammer mill so as to be milled to a desired size (e.g. 10-19 mm). Once the milling process is complete, the output may then be sent to a scrubber apparatus for further processing. The illustrated scrubber 30 includes an input hopper 32 at the bottom, an adjustable inclined chute 35 leading upward from the hopper, and a rotatable auger 37 deployed inside and along the length of the chute. The angle of the chute 35 and the rotational speed of the auger 37 may be adjusted depending on the quantity and density of the material introduced therein to provide efficient processing and to avoid clogging. The bottom surface of the chute has a plurality of openings therein and may be made from mesh or wire screen 39, and the top of the chute may be open. Rotation of auger 37 causes the fibrous plant material deposited into the hopper 32 to be urged upward through chute 35. As the fiber moves upward in chute 35, screen 39 prevents larger plant fibers (bast) from exiting through the bottom of the chute, allowing the smaller fibers (hurd) to drop through. Rotation of the auger 37 also keeps the fiber moving though the chute, and helps prevent clogging of the screen 39. Different sized mesh or openings may be provided in screen 39 to allow separation of different sized plant fibers. For example and without limitation, smaller openings may be provided in screen 39 to allow smaller sized fibers to drop through, whereas larger sized openings may be provided to allow larger sized fibers to drop through. It has been determined that a mesh size of about 1 1/4" to 1 1/2" openings, that may be diamond shaped may result in approximately 95% of bast fiber to be removed from hurd dropping through the screen 39. The position of the auger 37 in trough 35 may be adjustable up or down, allowing the auger to be brought down as close as 3/4 inch above screen 39. Longer fibers that are not separated exit from the scrubber 30 at discharge opening 36.

It is to be appreciated that different embodiments of the scrubber 30 may have different dimensions. For example and without limitation, the chute 35 may have a length of between about five and about 15 feet, preferably about 10 feet, and chute 35 may have a diameter of between about 10 and about 20 inches, preferably about 16 inches. In other examples and without limitation, the ends (flights) 33 of auger blades 38 may have tips or edges made of UHMW (ultra-high molecular weight) plastic; in some of these embodiments, the plastic may be between about 1/4 inch and about 1 inch, preferably about ½ inch. In other examples and without limitation, the legs supporting the chute 35 may be adjustable form a generally horizontal position to an upward angle of as much as sixth degrees, preferably about 45 degrees. In other examples and without limitation, the screen 39 covers as much as the bottom half of the trough 35, half way up side of auger; and the discharge opening 36 at the end may have a size between 10 inches and 20 inches, preferably about 12 to 14 inches. It is to be appreciated that these variables, along with the up/down position and speed of the auger 37 may be adjusted based on such things as the density, moisture level and quantity of fibrous material to be processed.

Figure 3:
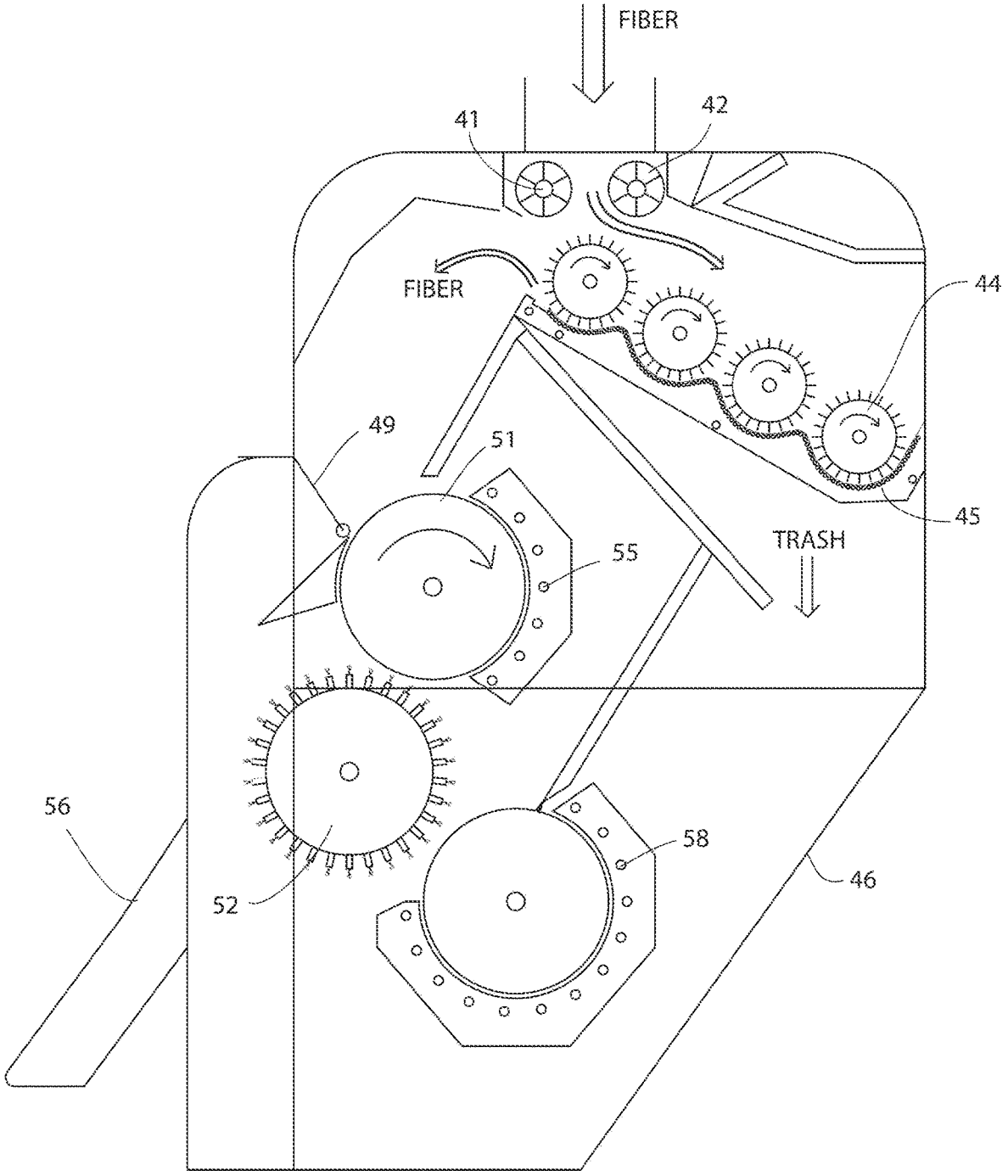
FIG. 3 is a side schematic view of an embodiment of a feeder apparatus of the present invention.
Figure 4:
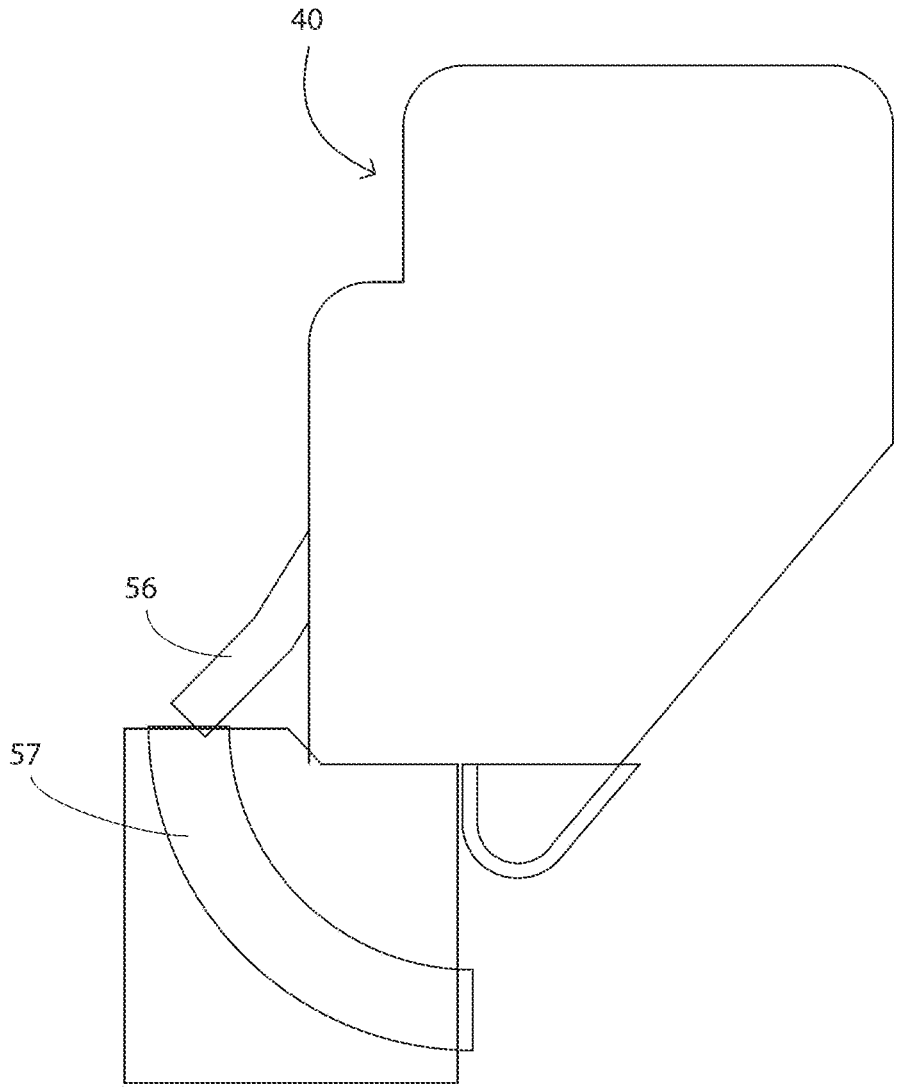
FIG. 4 is an exterior side view of the feeder embodiment of FIG. 3 with angled duct.

FIG. 3 illustrates an embodiment of a feeder unit 40 that has been adapted from an existing cotton gin feeder. Fiber that has exited from a stick machine 20 may be fed into the top of the feeder 40 and passes between two adjustable speed feeder rollers 41, 42, which may be fluted. One of the rollers (e.g. 41) is designed to rotate faster than the other (e.g. 42) in order to spread out the fibrous material. In some embodiments, this ratio of speeds may be approximately 3:1, although other ratios such as 3.5:1, 2.5:1, 2:1 and 1.5:1 may also be used to obtain similar results. An electronic control may be used to adjust the speed of the feed rollers. The bast fiber is then passed through four inclined/angled spike cylinders 44 over slotted screens 45. In some embodiments, the screens 45 may have openings sized as large as about 2" by about ½" to as small as about 1" by about ⅛", and preferably about 1½" by about 3/16". This process allows hurd and trash (dirt, sticks, stems, leaves, etc.) to be cleaned/removed from the fiber and then sent down a slide 46 to a trash conveyor. The fiber exiting from the cylinders 44 travels to two rotatable extractor saw cylinders, upper cylinder 51 and lower cylinder 53. Fiber is removed from both cylinders 51 and 53 using a rotatable doffer drum 52 with brushes. A plurality of grid bars 55 are provided along a side of upper cylinder 51 to help keep the bast fiber close to saw 51, while allowing hurd and trash to exit between the bars 55. In some embodiments, the grid bars may be spaced about 2 inches apart. In some embodiments seven bars 55 may be provided adjacent to upper cylinder 51. Another plurality of grid bars 58 may be provided below and partially around lower cylinder 53 which also keep the fiber close to cylinder 53 for removal by doffer 52, with hurd and trash exiting between bars 58. In some embodiments seven bars 58 may be provided adjacent to lower cylinder 53. Doffing brush cylinder 52 in between the saw cylinders 51, 53 removes fiber from the cylinders (doff them) and onto a stationary apron 57. A bypass valve 49 may be provided, and used when working with fine fiber that does not need to be cleaned by the saw cylinders 51, 53. Valve 49 allows such fiber to be sent directly to the exit apron 57.

Figure 5:
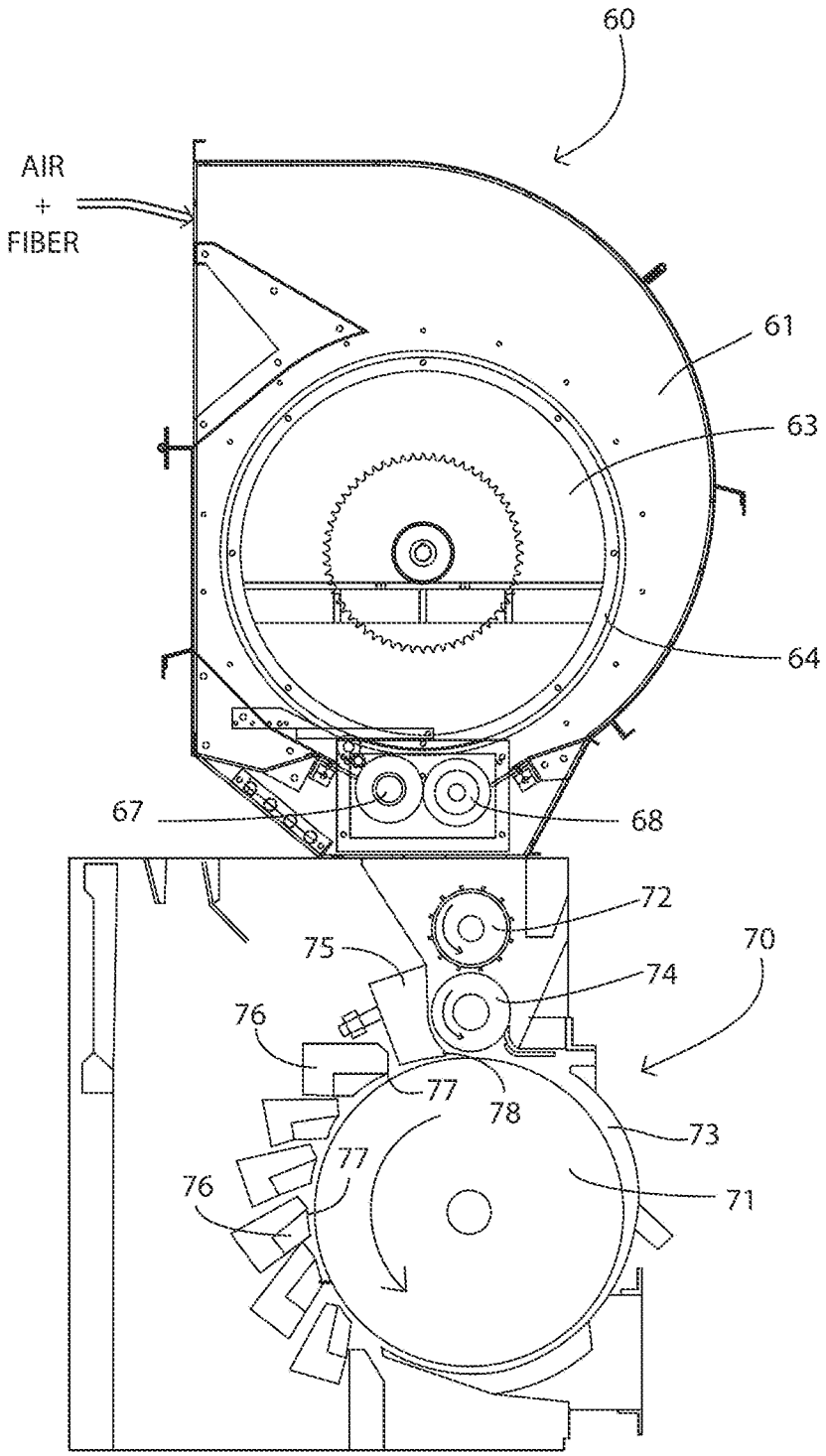
FIG. 5 is a side schematic view of an embodiment of a condenser and combing apparatus of the present invention.

In embodiments of the invention, the fiber output from feeder unit 40 may then be directed from apron 56 through a rectangular duct 57 to a condenser 60 and combing apparatus 70. An embodiment of a condenser/comber is illustrated in FIG. 5. The condenser 60 includes a chamber 61 having a centrally mounted rotating drum 63 mounted therein. The exterior surface of the drum 64 includes a plurality of openings, wire mesh or screen, and the center of the drum is attached to air removal devices (not shown). The air removal devices cause the fiber entering the chamber to be sucked against the openings, mesh or screen on the surface 64 of the drum 63 as it rotates. In embodiments of the invention, a pair of fluted rollers 67, 68 are provided below the drum 63 to strip the fiber from the screen surface 64 of the drum as it rotates. In some embodiments, one or more steel plates 69 may be provided to stiffen the flashing against the fluted rollers 67, 68. In embodiments of the invention, plates 69 may be 3" wide and ⅛" thick.

Figure 6:
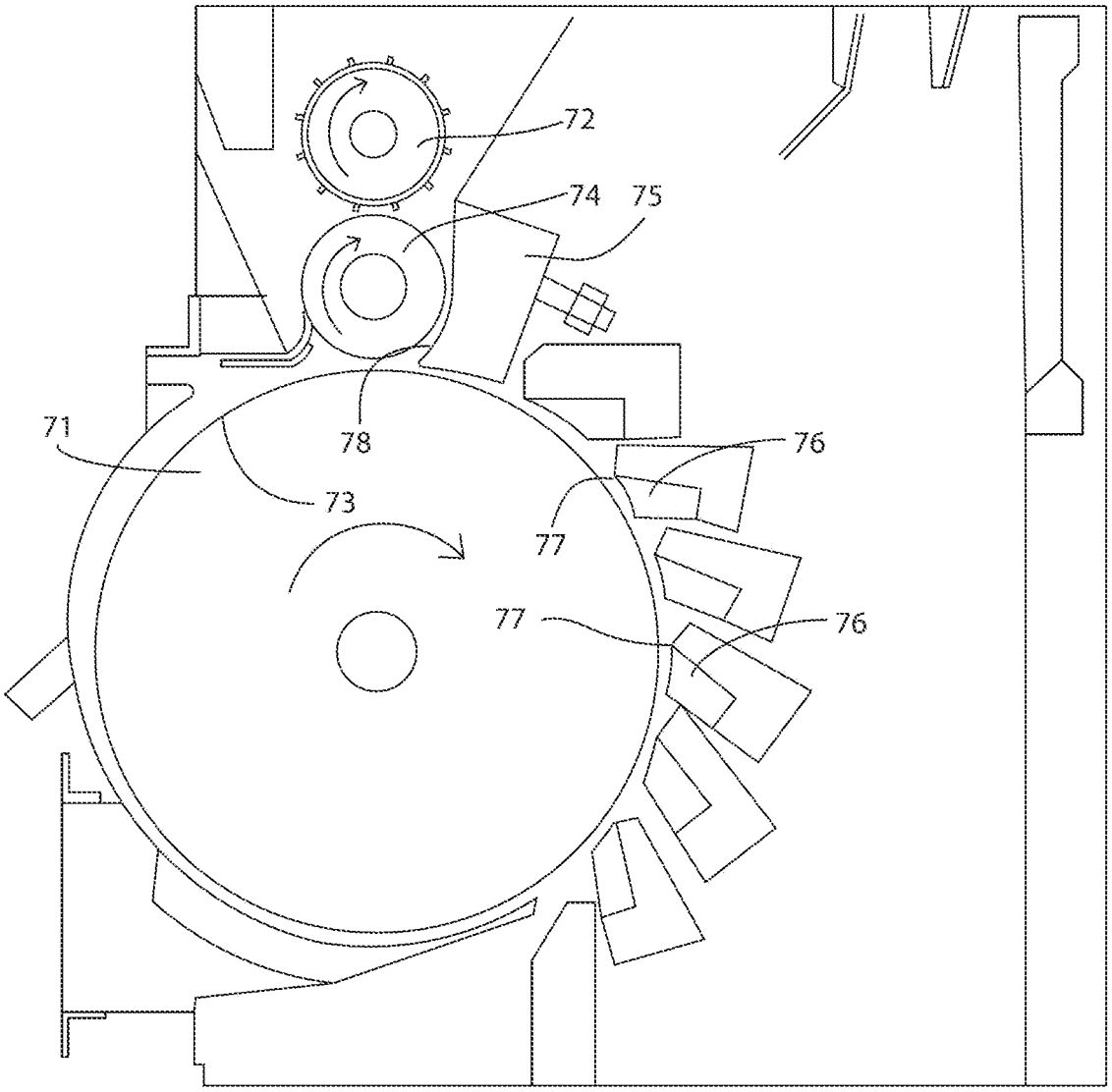
FIG. 6 is a detailed side schematic view of an embodiment of a combing apparatus of the present invention.

In embodiments of the invention, the fiber stripped from the drum is then dropped into a combing apparatus 70, as shown in FIGS. 5 and 6. Apparatus 70 may include a large central rotatable saw drum 71 having lint combing teeth 73 on the outer surface thereof which engage the incoming fiber. Two feed rollers 72, 74 are provided above drum 71. A feed bar 75 may be provided adjacent to the input area below the lower smooth feed roller 74. Feed bar 75 may have a leading edge or toe 78 that may have a radius of between about 1/16" and about ¼", preferably about ⅛" that is spaced so as to be almost touching drum teeth 73. A plurality of grid bars 76 may be spaced around a portion of the circumference of drum 71, each having a knife edge toe or blade 77 that is spaced so as to be almost touching drum teeth 73 for removing trash. In some embodiments, a space of between about 1/16" and about ¼", preferably about ⅛" may be provided between each grid bar 76 and drum 71. As the fiber on the drum 71 encounters the blades 77, it is combed to remove any remaining foreign material. The fiber is then removed from the drum resulting in elongated fibrous output suitable for many different high-fiber applications. The hurd removed during these processes is usually of high quality making it suitable for use in building materials, paper, paperboard, composites and the like. Hurd output from the stick machine 30, from the feeder 40 and/or from the lint comber 70 may be introduced into a scrubber as shown in FIG. 2 for further purification.

In use, fibrous plants are harvested by severing them from the ground, and then removing leaves and branches from the stalks. The stalks are then fed into an embodiment of a stick machine where the stalks are squeezed between rotating saw cylinders and adjacent blades to begin the separation of outer fiber from inner fiber and trash. The longer, outer fibers adhere to the saw blades and is removed using one or more doffers, and the shorter inner fibers and trash drop through the stick machine. In some embodiments, the inner fibers may then be sent to a hammer mill for processing to a desired size, and then introduced into a scrubber where they are advanced through an upwardly inclined chute using an auger. The lower surface of the chute comprises openings or a screen for further separating the shorter fibers from other fibers and materials. The screen may be sized in order to obtain shorter fibers of a desired length that may then be used for building materials, paperboard and the like.

In other embodiments, the outer fibers that exit from the stick machine are introduced into a feeder through a pair of rollers at the top. One of the rollers travels at a faster speed than the other in order to spread out the fibers as they pass between them. These fibers then encounter a plurality of inclined rotating spiked cylinders above a screen such that passing the fibers between the spiked cylinders and the screen further separates smaller fibers and trash from the longer fibers. The smaller fibers and trash drop through the feeder, and the longer fibers then encounter one or more rotating saw blades with adjacent grid bars for further removal of small fibers and trash. A rotating doffer then removes the longer fibers from the saw blades.

The longer fibers that exit from the feeder then encounter a condenser comprising a rotating drum having a surface comprising a plurality of openings or a screen, and an inner air removal or suction which causes the fibers to adhere to the screen. A pair of fluted rollers at the bottom of the drum remove the fibers and introduce them to a lint comber apparatus. The fibers make a sharp turn at a toe of a feed bar and then encounter a plurality of combing blades which remove fine trash and foreign material from the fiber, making it suitable for use.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein, and that different combinations of the features of the illustrated embodiments may be used in other embodiments, all within the scope of the invention. The illustrated embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A method for obtaining purified inner hurd from hemp plant stalks comprising the steps of:

a) introducing harvested hemp plant stalks into a top of an initial separation apparatus comprising:

i) three rotating saw cylinders, each of said rotating saw cylinders having an exterior surface and comprising a plurality of blades, with each of the plurality of blades having a plurality of teeth thereon, and ii) three fiber removal brushes, of each said three brushes adjacent to a corresponding one of said three saw cylinders;

b) separating inner and outer fibers of the plant stalks by:

i) passing the stalks between the plurality of teeth of a first of said saw cylinders and underneath a first of said brushes, such that separated outer fibers are removed and inner fibers drop away from said first saw cylinder;

ii) passing the inner fibers that drop away from said first saw cylinder between the plurality of teeth of a second of said saw cylinders and underneath a second of said brushes, such that additional outer fibers are removed and inner fibers drop away from said second saw cylinder;

iii) passing the inner fibers that drop away from said second saw cylinder between the plurality of teeth of a third of said saw cylinders and underneath a third of said brushes such that more outer fibers are removed and inner fibers drop away from said third saw cylinder and exit from said initial separation apparatus;

c) sending the inner fibers through a hammer mill for further processing;

d) sending the processed inner fibers from said hammer mill to a lower end of a scrubber comprising a trough having an adjustable incline, the trough having an elongated bottom, elongated sides and an elongated open top and a mesh having diamond-shaped openings therein along a bottom surface of said trough, and a rotatable auger extending axially through said trough; and e) rotating said auger to urge said processed inner fibers upward through said inclined trough causing purified smaller hurd to drop through said mesh and larger fibers to be carried upward.

2. The method of claim 1 wherein the hammer mill produces inner fibers having a length of between about 10 and about 19 millimeters.

3. The method of claim 1 wherein the lower end of said scrubber comprises an input hopper.

4. The method of claim 1 wherein a position of the auger inside the trough is adjustable.

5. The method of claim 4 comprising a further step of adjusting the position of the auger so that the auger extends in a same direction as the bottom surface of said trough, and is about ¾ inch above the bottom surface of said trough.

6. The method of claim 1 wherein the auger comprises blades having flights at ends thereof made of ultra-high molecular weight plastic.

7. The method of claim 1 wherein said auger comprises blades having tips thereon made of plastic.

8. The method of claim 1 wherein said plurality of blades have a length of between 1/16 inch and ¼ inch, said plurality of teeth have a depth of between 1/16 inch and ¼ inch, and the blades are separated from each other by a space of between ¼ inch and ¾ inch.

9. The method of claim 1 wherein said plurality of blades have a length of ⅛ inch, said plurality of teeth have a depth of 5/16 inch, and the blades are separated from each other by a space of ½ inch.

* * * * *